United States Patent [19]

Dimitriu

[11] Patent Number: 4,775,288

[45] Date of Patent: Oct. 4, 1988

[54] HIGH-LIFT LOADER

[75] Inventor: Dan G. Dimitriu, Fargo, N. Dak.

[73] Assignee: Dynamic Industries, Inc., Barnesville, Minn.

[21] Appl. No.: 914,783

[22] Filed: Oct. 3, 1986

[51] Int. Cl.[4] ..... B66F 9/06

[52] U.S. Cl. ..... 414/708; 414/718

[58] Field of Search ..... 414/718, 728, 685, 700, 414/708; 91/520

[56] References Cited

U.S. PATENT DOCUMENTS

| | | | |
|---|---|---|---|
| Re. 30,021 | 6/1979 | Olson et al. | 414/547 |
| 3,220,581 | 11/1965 | Pedersen et al. | 414/708 |
| 3,253,671 | 5/1966 | Fielding | 180/134 X |
| 3,261,485 | 7/1966 | Anderson | 414/718 |
| 3,270,899 | 9/1966 | Brown et al. | 414/547 |
| 3,288,316 | 11/1966 | West | 414/685 X |
| 3,305,047 | 2/1967 | Bronder | 414/685 X |
| 3,327,879 | 6/1967 | Lull | 414/704 |
| 3,407,947 | 10/1968 | Valla | 414/718 |
| 3,811,587 | 5/1974 | Seaberg | 414/700 |
| 3,843,004 | 10/1974 | Kambe | 414/700 |
| 3,927,781 | 12/1975 | Okabe | 414/700 |
| 3,937,339 | 2/1976 | Geis et al. | 414/697 |
| 3,967,744 | 7/1976 | Goyarts | 414/718 X |
| 3,985,248 | 10/1976 | Liegel et al. | 414/718 |
| 4,034,875 | 7/1977 | Pugh et al. | 212/55 X |
| 4,039,094 | 8/1977 | Grove | 280/638 X |
| 4,042,135 | 8/1977 | Pugh et al. | 280/6.11 X |
| 4,147,263 | 4/1979 | Frederick et al. | 414/728 X |
| 4,266,908 | 5/1981 | Leiker | 414/690 |
| 4,355,477 | 10/1982 | Holmgren et al. | 414/685 X |
| 4,382,743 | 5/1983 | Newell | 414/692 |
| 4,427,334 | 1/1984 | Copie et al. | 414/685 X |
| 4,431,363 | 2/1984 | Waite | 414/687 |

OTHER PUBLICATIONS

*Equipment Guide News,* Mar., 1983, "Superlift Combines Crane, Forklift and Aerial Functions".

*Primary Examiner*—Robert J. Spar
*Assistant Examiner*—Donald W. Underwood
*Attorney, Agent, or Firm*—Burd, Bartz & Gutenkauf

[57] ABSTRACT

A self-propelled, low-profile, high-lift loader having the ability to lift loads higher above grade and lower below grade than previous such loaders of the same size category. The loader includes a main frame and a boom support frame pivotally connected at one end to the main frame. Power means are provided for elevating the opposite end with respect to the main frame. A boom butt is connected to the movable or free end of the boom support frame. The boom is pivotally rotatable about a horizontal axis on the boom support frame. Elevation of the boom support frame elevates the butt of the boom so as to extend the reach of the boom, as well as position the boom butt in an orientation permitting the boom to be extended downwardly to a below-grade location.

4 Claims, 6 Drawing Sheets

HIGH-LIFT LOADER

BACKGROUND OF THE INVENTION

Mobile high-lift loaders or trucks of the type having extendible and retractable booms are commonly used in construction sites or the like for lifting a load from the ground level to an elevated position, as when lifting mortar, building blocks, bricks or the like from the ground to an upper level of a building under construction. In more limited use, they are also used to move a load from ground level to a position below ground level. The boom is typically constructed of telescoping sections with a boom butt that is mounted in vertically stationary relationship with respect to a truck frame. The boom tip is typically elevated, retracted, and moved up and down by hydraulic means. The boom is moved angularly also by hydraulic means. The boom must be collapsible for over-the-road transportation of the vehicle from site to site. This limits the length of the boom and, accordingly, the maximum reach of the boom when performing a task.

The free end of the boom or boom tip is equipped with a load-handling assembly typically comprised as a forklift carriage carrying forktines. During boom rotation, it is usually desirable to keep the forktines level. This is done by operation of a hydraulic cylinder as the boom is pivoted. Generally a master-slave hydraulic motor combination is used. As the boom is elevated, one hydraulic cylinder follows the elevation of the boom and is followed by a second hydraulic cylinder which corrects the angular orientation of the load-handling member with respect to the tip of the boom. This results in the forklift or other load-handling member maintaining a level or other positional relationship.

SUMMARY OF THE INVENTION

The invention comprises a low-profile mobile high-lift loader or truck of the type having an extendible and retractable boom for lifting loads from ground level to an elevated work site or to a below-grade work site. The boom has telescoping sections for extension and retraction of the boom tip relative to the boom butt. The loader includes a stationary frame which is situated in vertically stationary relationship with respect to the ground. One end of a movable frame is pivotally connected to the stationary frame for rotation about a first normally horizontal axis. The other end of the movable frame is elevated and lowered upon rotation of the movable frame about the horizontal axis. The boom butt is mounted on the movable end of the movable frame for rotation about a second horizontal axis that is parallel to the first horizontal axis. In the lowered position, the boom is essentially parallel to the movable frame. Upon elevation, the boom rotates in a direction that is opposite to that of the movable frame when it is elevated. Elevation of the movable end of the movable frame elevates the boom butt. This vertically extends the reach capability of the boom. It also positions the boom butt such that when the boom is situated in parallel relationship to the movable frame, it is orientated in a downward direction at an angle permitting substantial downward reach upon extension of the boom.

A load-handling member, such as a forklift, can be connected to the boom tip. A master-slave hydraulic cylinder assembly is connected between the load-handling member and the movable frame by a balance arm located at the pivotal juncture of the boom butt and the movable frame to keep the load member level upon rotation of the movable frame.

IN THE DRAWINGS

DESCRIPTION OF PREFERRED EMBODIMENTS

Figures 1, 6:
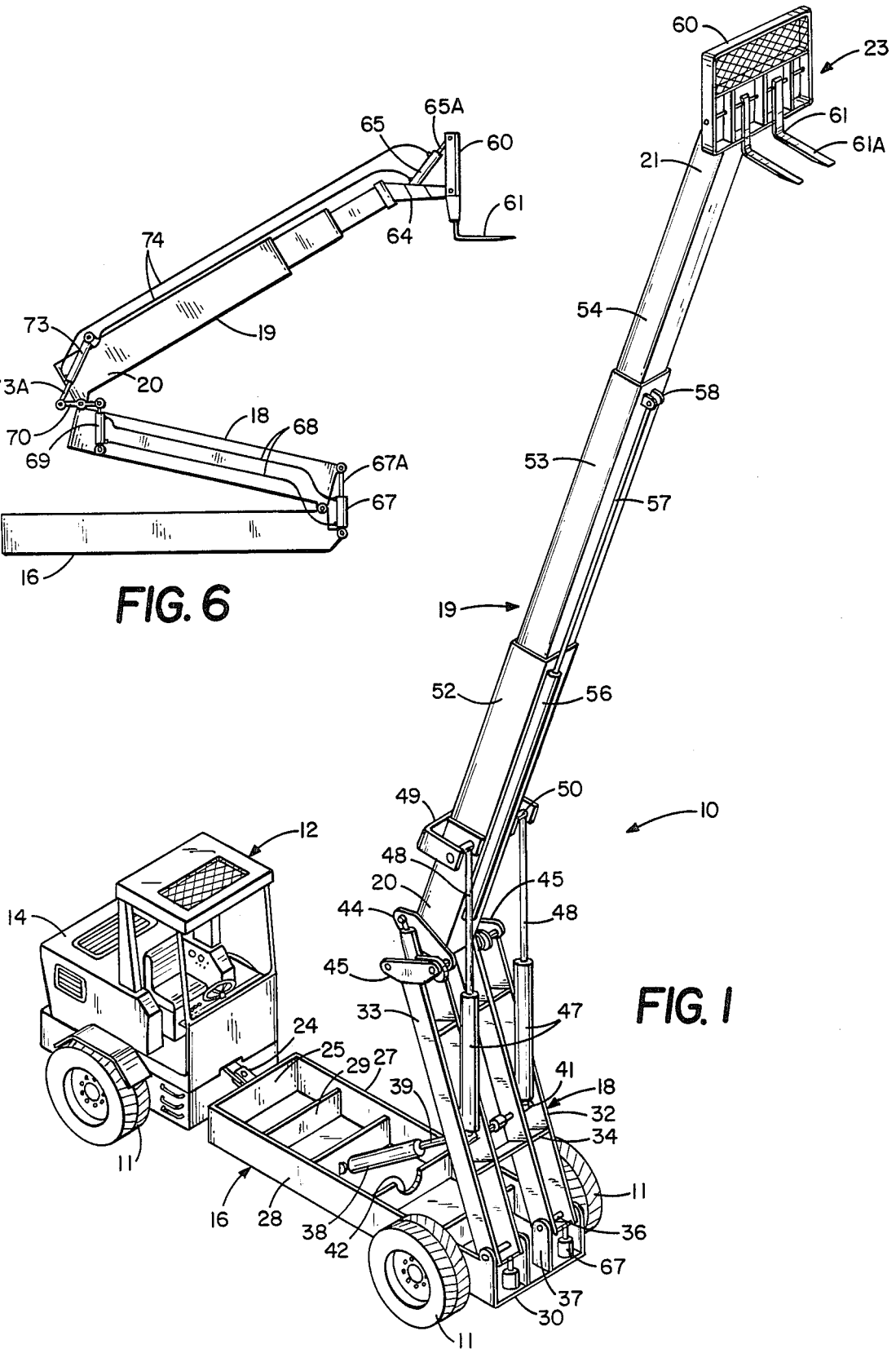
FIG. 1 is a perspective view of a high-lift loader according to one form of the invention with the boom and boom support frame elevated and the boom extended.
FIG. 6 is a schematic side elevational view of the boom support frame and boom showing the hydraulic master-slave cylinder assembly useable to maintain the positional relationship of the load-lifting member.

Referring to the drawings, there is shown in FIGS. 1 through 4 a mobile high-lift loader according to the invention indicated generally at 10. Loader 10 is adapted to lift loads higher than other high-lift loaders and also lower below grade than such previous machines of the same size category. Loader 10 is mobile having the usual array of wheels 11 and a cab or operator's compartment 12 adjacent an engine located in engine compartment 14 in order to provide mechanical power to the wheels and drive various hydraulic pump assemblies (not shown) to furnish hydraulic power to the various hydraulic units to be described. A complement of closely grouped controls is located in the operator compartment convenient for ease of access by the operator when operating the high-lift mechanism or driving the loader over the road. The wheels 11 support the loader 10 with respect to the ground 15 or other supporting surface. Outrigger stabilizers could also be provided (not shown).

High-lift loader 10 includes a frame assembly having a main stationary frame 16 connected in articulate trailer relationship behind the cab 12 and supported by a rearward set of wheels 11. A movable boom support frame 18 is pivotally connected at a first end to the front end of the stationary frame 16 for pivotal movement about a first fixed generally horizontal axis to elevate and lower the second end of the movable frame 18. A boom 19 is pivotally connected at its butt end 20 to the second end of the movable frame 18 for pivotal movement about a second movable generally horizontal axis that is parallel to the first horizontal axis. The direction of rotation to elevate the boom about the second horizontal axis is opposite to the direction of rotation to elevate the second end of the movable frame about the first horizontal axis. The tip 21 of boom 19 is equipped with load-handling means shown as a forklift assembly 23. As shown in FIG. 1, upward elevation of the second end of the movable frame 19 is operative to move the boom butt 20 upward to increase the vertical reach of the boom 19 when it is elevated about the second horizontal axis on the second end of the movable frame 18.

Stationary frame 16 is articulately connected to cab 12 as by articulate connection means 24 connected to an end frame member 25 (FIG. 1). Parallel longitudinal side frame members 27, 28 extend from the end member 25 to the opposite end of stationary frame 16. Lateral brace members 29 extend between side members 27, 28. A bottom wall 30 closes the bottom of the front end of the stationary frame 16.

Movable support frame 18 includes parallel legs 32, 33 formed of spaced apart parallel structural members and connected by lateral braces 34. At its fixed end, movable frame 18 is pivotally connected to the outward end of stationary frame 16 by horizontal pivot pins 36 extended inwardly from the lateral sides 27, 28 of the stationary frame 16 and connected to upstanding lugs 37.

A hydraulic power unit or motor is effective to lift and lower the movablesupport frame 18 relative to the stationary frame 16. A hydraulic motor is comprised as a hydraulic piston cylinder of the type having a cylinder 38 connected to a cross member 29 of the stationary frame 16. A rod 39 is extendable and retractable to the cylinder 38 and is pivotally connected to a horizontal bar 41 transversely extended across an intermediate portion of the movable frame 18. As shown in FIG. 1, a cradle 42 is provided in one of the cross members 29 to fit the cylinder 38 when the movable frame 18 is in the lowered or retracted position of FIG. 2. Extension of the rod 39 relative to the cylinder 38 is effective to lift the movahle frame hetween the lowered, horizontal position parallel to the stationary frame 16 like that shown in FIG. 2, and the elevated position like that shown in FIGS. 1, 4 and 5. Suitable controls are located in cab 12 for operation of cylinder 38.

Butt end 20 of boom 19 is pivotally connected to the movable end of movable frame 18 for rotatable movement about a second horizontal axis that is parallel to the first horizontal axis. Elevation of boom 19 is accomplished by rotation about the second horizontal axis in a direction opposite the direction of rotation to elevate movable frame 18 upon rotation about the first horizontal axis. Mounting brackets 44 fixed to the boom butt 20 are pivotally connected to mounting brackets 45 secured to the movable end of the lift frame 18 for rotation of boom 19 about the second horizontal axis.

Elevation and lowering of boom 19 about the second horizontal axis is achieved by hydraulic motor means of the cylinder and piston-rod variety. A pair of symmetrical hydraulic cylinders 47 are pivotally mounted at one end to the cross brace 41 of movable frame 18. Rods 48 are extendible and retractable relative to the cylinders 47. The outer ends of the rods 48 are pivotally connected to boom 19. A bracket 49 partially surrounds the boom 19 and carries a pin 50 for pivotal connection to the rod ends. In the configuration shown, extension and retraction of the rods 48 results in elevation and lowering respectively of the boom 19. In the elevated position of FIGS. 1 and 4, the boom butt is elevated substantially above the normal position situated on the truck bed or stationary frame 16. The vertical reach of the boom is increased to reach greater heights and also to position the boom butt at a location clear of the truck whereby the boom can be used in a downwardly extended position like that shown in FIG. 5.

Figure 2:
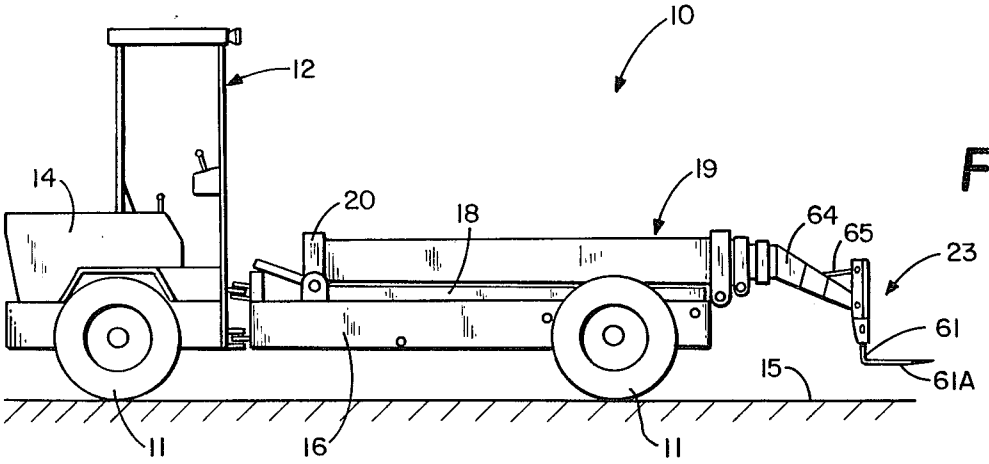
FIG. 2 is a side elevational view of the high-lift loader of FIG. 1 with the boom retracted and the boom and boom support frame lowered.
Figure 3:
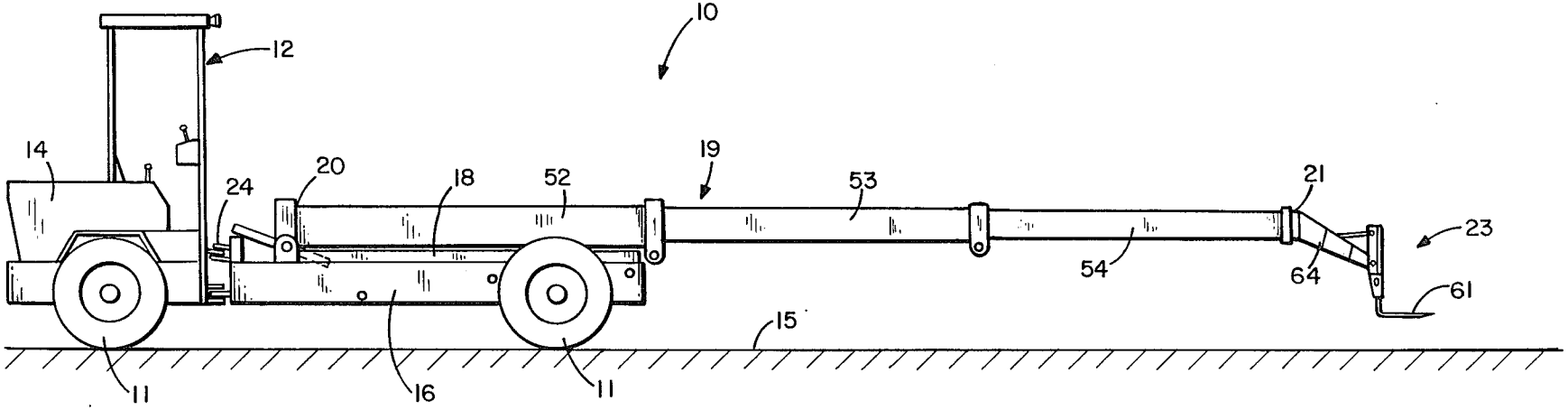
FIG. 3 is a side elevational view like that of FIG. 2 with the boom extended.

Boom 19 is comprised of a plurality of boom sections assembled in telescopic relationship for extension to a full working length, and retraction to a contracted length for over-the-road travel as shown in FIG. 2. Boom 19 includes a first boom section 52, a second boom section 53, and a third boom section 54. The first boom section 52 includes the boom butt 20 at the lower end. The second boom section 53 is telescopically engaged in the first boom section 52 for extension and retraction with respect thereto. The third boom section 54 is telescopically engaged in the outward end of the second boom section 53 for extension and retraction relative thereto. Extension and retraction of the second boom section 53 with respect to the first boom section 52 is accomplished by a first boom extension hydraulic motor. As shown in FIG. 1, a cylinder 56 is fixed to the outside of the first boom section 52 in conventional fashion. A rod 57 extends from the cylinder 56 and is connected to a fitting 58 on the outward end of the second boom section 53. Rod 57 is extendible and retractable relative to the cylinder 56 which in turn extends and retracts the second boom section 53 with respect to the first boom section 52. The third boom section 54 is extendible and retractable by a system of chains and pulleys located interiorly of the boom structure (not shown). The boom is extendible between the full working length shown in FIG. 1 with the boom sections extended relative to one another, to the contracted or foreshortened over-the-road travel length of FIG. 2.

Boom tip 21 is located at the outer end of the third boom section 54 and carries load handling member 23 shown comprised of a forklift assembly including a normally vertical forklift frame 60, which carries L-shaped forklift tines 61 for lifting and lowering heavy loads. The forklift frame 60 is pivotally connected to an end piece or mount 64 connected to the boom tip 21 on third boom section 54. A load-carrying member hydraulic motor is effective to maintain the horizontal portions 61A of the lift tines 61 in a level orientation or other desired orientation. The hydraulic motor comprises a cylinder portion 65 pivotally connected to the boom tip 64. Operation of the cylinder 65 is effective to adjust the angular position of the forklift frame 60 relative to the boom tip 64.

In operation of high-lift loader 10, it is moved over the road from place to place in the configuration of FIG. 2 with the movable frame 18 retracted and somewhat nested within the stationary frame 16, and the boom 19 in a fully retracted configuration. In this position, the movable frame lift cylinder 38 is fully retracted and is positioned in the stationary frame 16 at a slight angle with respect to movable frame 18 in order to have some measure of mechanical advantage necessary to move the movable frame 18 upon extension of rod 39 from cylinder 38. The boom lift cylinders 47 are also fully retracted so that the collapsed boom 16 lies somewhat parallel to and upon the movable frame 18 and stationary frame 16. The boom can be extended from the configuration shown in FIG. 2 to that shown in FIG. 3 and then elevated through use of the boom lift cylinders 47 so that the loader can be used in conventional fashion with the stationary frame 16. However, in order to obtain a greater vertical lift, the movable lift cylinder 38 can be actuated to lift the second end of the movable frame 18 to the vertically elevated position of FIGS. 1 and 4. In this position, an increase in elevation is obtained according to the amount of elevation of the boom butt 20 above the resting position with respect to the stationary frame 16. This can typically be a distance of approximately fourteen feet. A load being carried by the forklift assembly 60 is moved horizontally by movement of the entire loader 10. Alternatively, the load can be moved horizontally by combined movements of the controls of the movable frame cylinder 38 and the hydraulic motors 56 to extend and retract the boom. For example, in the configuration shown in FIG. 4, the forklift frame 60 can be moved from right to left by simultaneous retraction of the movable lift frame cylinder 38 and extension of the boom 19 by using the extend cylinder 56.

Figure 5:
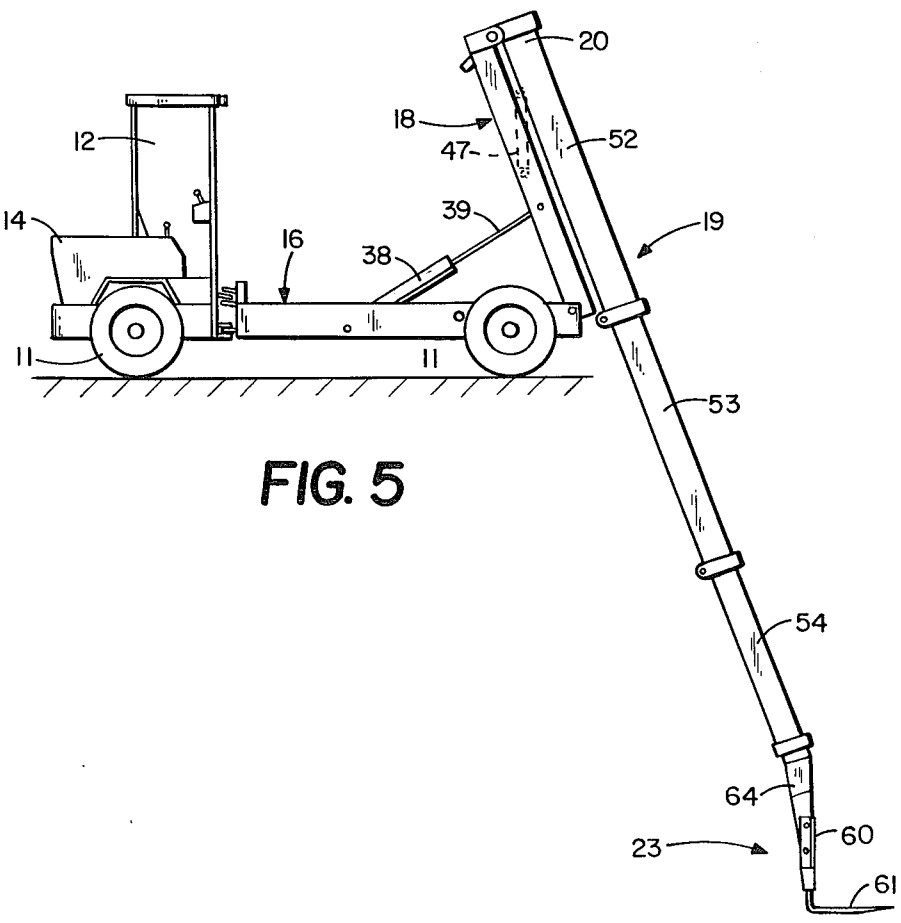
FIG. 5 is a side elevational view showing the boom support frame elevated and the boom extending downwardly below ground level.
Figure 4:
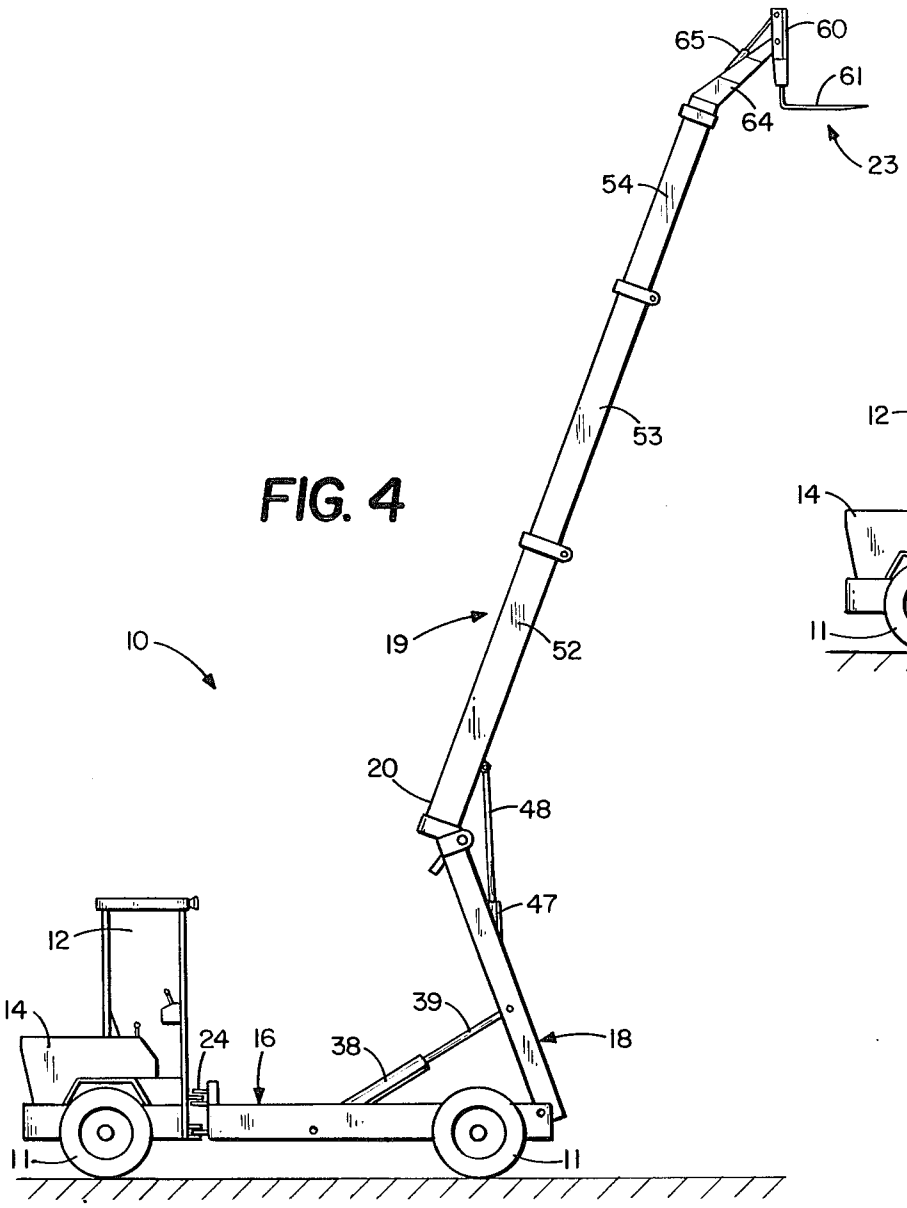
FIG. 4 is a side elevational view of the high-lift loader showing the support frame and boom elevated and the boom extended.

FIG. 5 shows the loader 10 in position to move loads between above and below grade locations. The movable frame motor 38 is operated to elevate the end of the movable frame 18 and locate the boom butt and boom in position where the boom is extendible downward in clearing relationship with respect to the stationary frame 16 and at a relatively steep angle. Operation of the forklift frame assembly motor 65 orientates the lift frame 60 in the correct position. Loads are lowered into a hole or lifted therefrom by operation of the movable lift frame cylinder 38 or by extension and retraction of the boom, or, as will usually be the case, a combination of the two.

FIG. 6 depicts schematically a master-slave hydraulic cylinder arrangement whereby forklift frame 60 is automatically maintained level or at such other preselected positional relationship upon elevation of the movable frame relative to the stationary frame 16, and upon elevation of the boom relative to the movable frame. While single hydraulic cylinders are shown in FIG. 6, they can and often will operate in symmetrical pairs.

A movable frame-slave cylinder 67 is connected between the movable frame 18 and stationary frame 16, such that the rod 67A retracts with respect to the cylinder body upon elevation of the movable frame 18. The movable frame-slave cylinders are also shown in FIG. 1. Hydraulic lines 68 connect both ends of the cylinder 67 to corresponding ends of a link cylinder 69 positioned at the opposite end of the movable frame 18. Link cylinder 69 is connected between the movable frame 18 and one leg of a balance or link member 70. Link member 70 is pivotally connected at the pivot juncture between the movable frame 18 and the boom butt 20. Link member 70 is freely pivoting. The opposite leg of link member 70 is connected to the rod 73A of a boom-slave cylinder 73. It can be seen that extension of the rod of the link cylinder 69 through the link 70 is effective to cause extension of the rod 73A of the frame tilt-slave cylinder 73. Hydraulic lines 74 connect the ends of the frame tilt-slave cylinder 73 to corresponding ends of the forklift frame tilt cylinder 65. As previously described, forklift frame tilt cylinder 65 is connected at one end to the boom tip fitting 64. The rod 65A is connected to the forklift frame 60, such that extension and retraction of the rod 65A angularly moves the forklift frame 60.

In use, upon elevation of the movable frame 18 relative to the stationary frame 16, the forklift tine 61 would assume a downward orientation but for the master-slave cylinder arrangement. Elevation of the frame 18 retracts the rod 67A of the cylinder 67. Through hydraulic lines 68, the rod of the link cylinder 69 is extended. Extension of the rod of the hydraulic link cylinder 69 also extends the rod 73A of the boom-slave cylinder 73. Through the hydraulic lines 74, this results in a retraction of the rod 65A of the tilt cylinder 65 so that the forklift frame 60 is angularly moved a distance or through an angle equal and opposite to the angle of movement of the movable frame 18 whereby the tines 61 are maintained level.

When the movable frame 18 is held stationary, and the hoom 19 is elevated relative to it, the boom-slave cylinder 73 and tilt cylinder 65 act in a normal master-slave cylinder arrangement, with the link member 70 remaining stationary. For example, lowering of the boom 19 relative to the movable frame 18 results in extension of the rod 73A of the boom-slave cylinder 73 against the stationary leg of link member 70. This results in retraction of the rod 65A of tilt cylinder 60 to angularly move the forklift frame 60 through a corresponding angle and maintain the tines 61 in level orientation.

Figure 7:
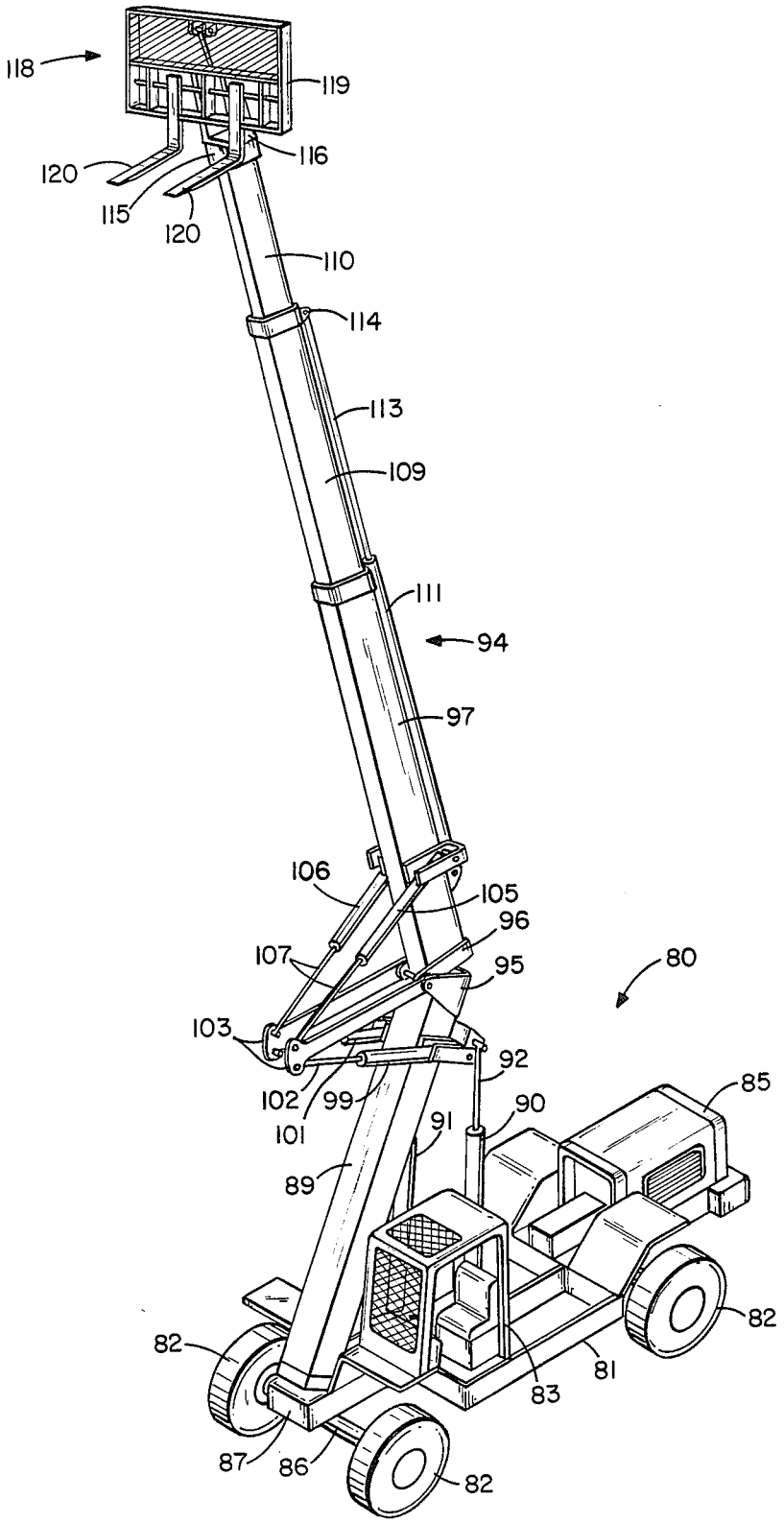
FIG. 7 is a perspective view of a high-lift loader according to a second form of the invention with the boom and boom support frame elevated and the boom extended.
Figure 8:
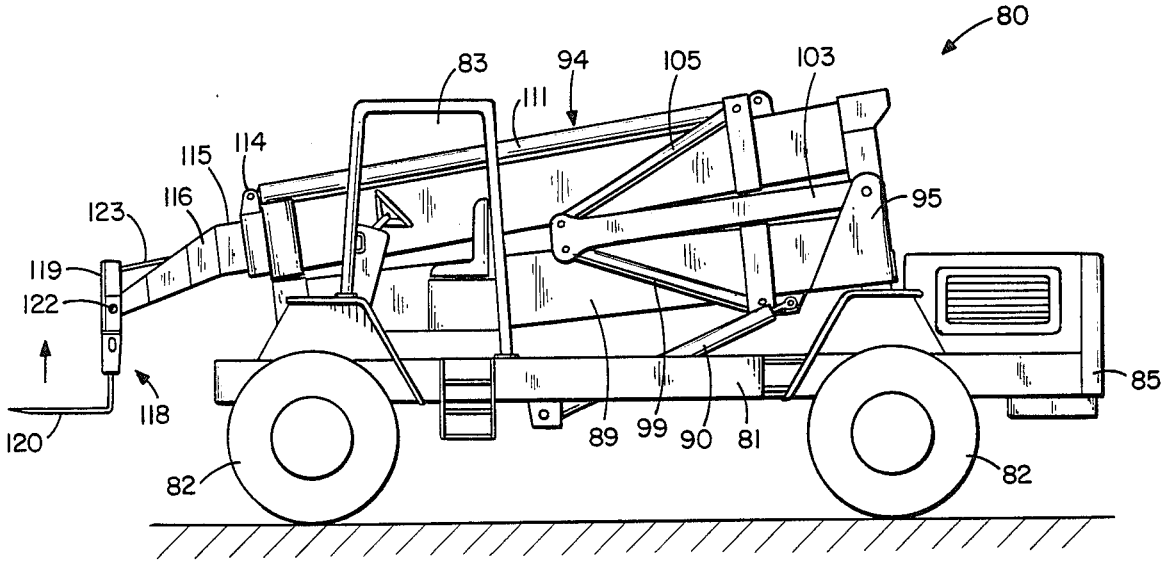
FIG. 8 is a side elevational view of the high-lift loader of FIG. 7 with the boom and support frame lowered and the boom retracted for over-the-road transport.
Figure 9:
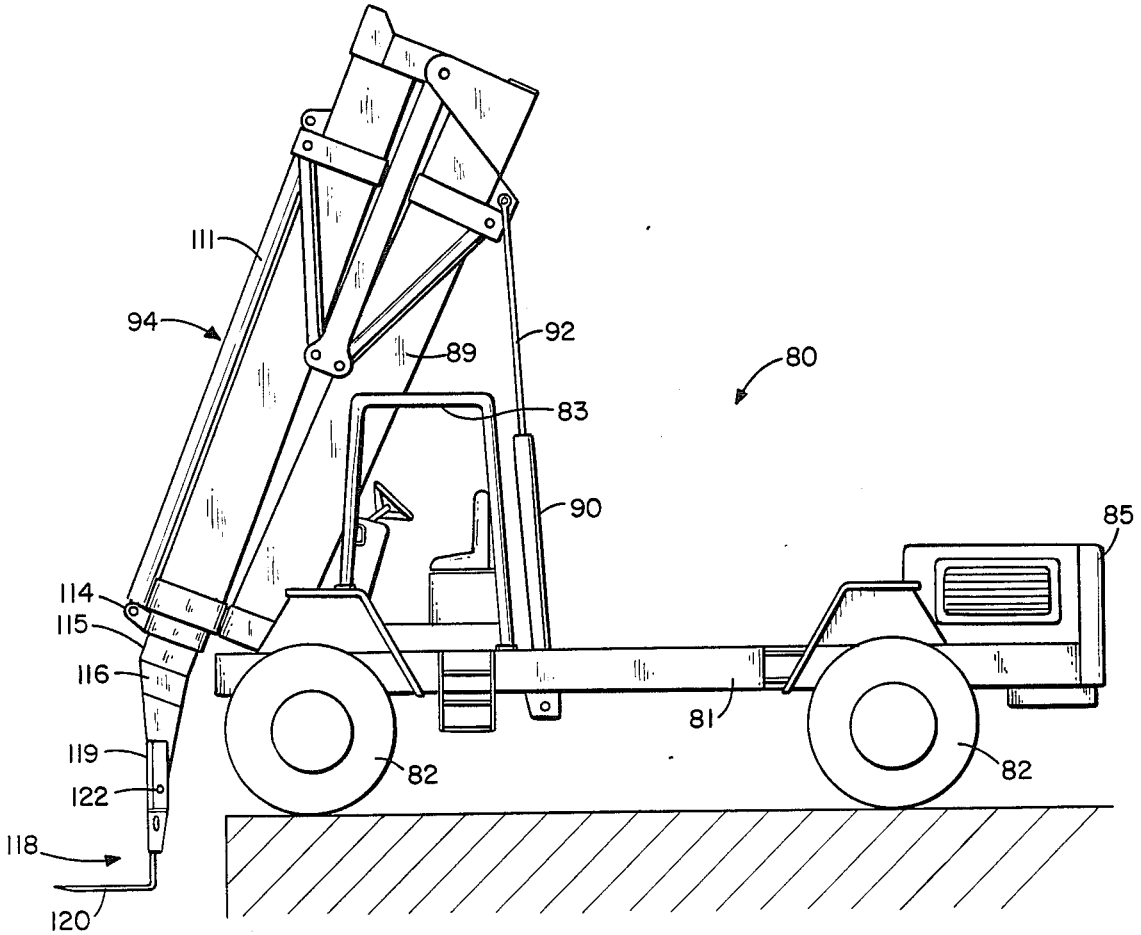
FIG. 9 is a side elevational view of the high-lift loader of FIG. 8 with the boom support frame elevated.

Referring to FIGS. 7 through 10, there is shown a high-lift loader according to another form of the invention indicated generally at 80. At FIG. 7, the high-lift loader is shown in perspective with the boom assembly in the upwardly extended configuration. In FIG. 8, the high-lift loader 80 is shown in the retracted over-the-road travel position. In FIG. 9, the loader is shown in position preparatory to lowering the boom to a below-grade location, and in FIG. 10 the high-lift loader is shown with the lift frame elevated and the boom elevated but retracted.

High-lift loader 80 includes a chassis frame 81 carried by wheels 82 and supporting an operator's cab 83 toward the front end thereof. An engine is housed in an engine compartment 85 rearwardly mounted on chassIs frame 81. Front wheels 82 are connected by an axle 86. The load-lifting apparatus of loader 80 is located in side-by-side relationship to the cab 83 which, together with the forward position of cab 83, provides distinctive visual advantages to the operator. Load-lifting apparatus includes a stationary frame 87 integral with chassis frame 81 and located alongside the operator's cab 83. A movable frame 89 is pivotally connected at a first end to the stationary frame 87 for rotation about a first fixed horizontal axis to elevate and lower the second end thereof. The movable frame 89 is connected at its fixed end to the forward end of the stationary frame 87. The rotation is about a horizontal axis which is perpendicular to the longitudinal axis of the loader 80. A pair of hydraulic power units 90, 91 are fixed at one end to the stationary frame 87. Extendible and retractable rods 92 extend from the power units 90, 91 and are connected at an intermediate location on movable frame 89. In the retracted position of FIG. 8, the movable frame 89 is lowered with the movable end resting on an elevated portion of the fixed frame 87. The power unit 90 has one end mounted beneath the movable frame 89 to provide a moment arm upon commencing of the lifting of the movable frame 89. Upon extension of the rod 92, the movable end of the movable frame 89 moves from the retracted position shown in FIG. 8 to the extended position shown in FIGS. 7 and 9 through 10.

A boom 94 is pivotally connected to the movable end of boom support frame 89. An end collar 95 is fixed on the end of the movable frame 89. The butt 96 of a first boom section 97 is equipped with a collar that is pivotally connected to the movable frame collar 95 for rotation about a second movable horizontal axis to elevate and lower the boom. Rotation about the second horizontal axis to elevate the boom is in a direction opposite rotation about the first horizontal axis to elevate the movable frame.

Figure 10:
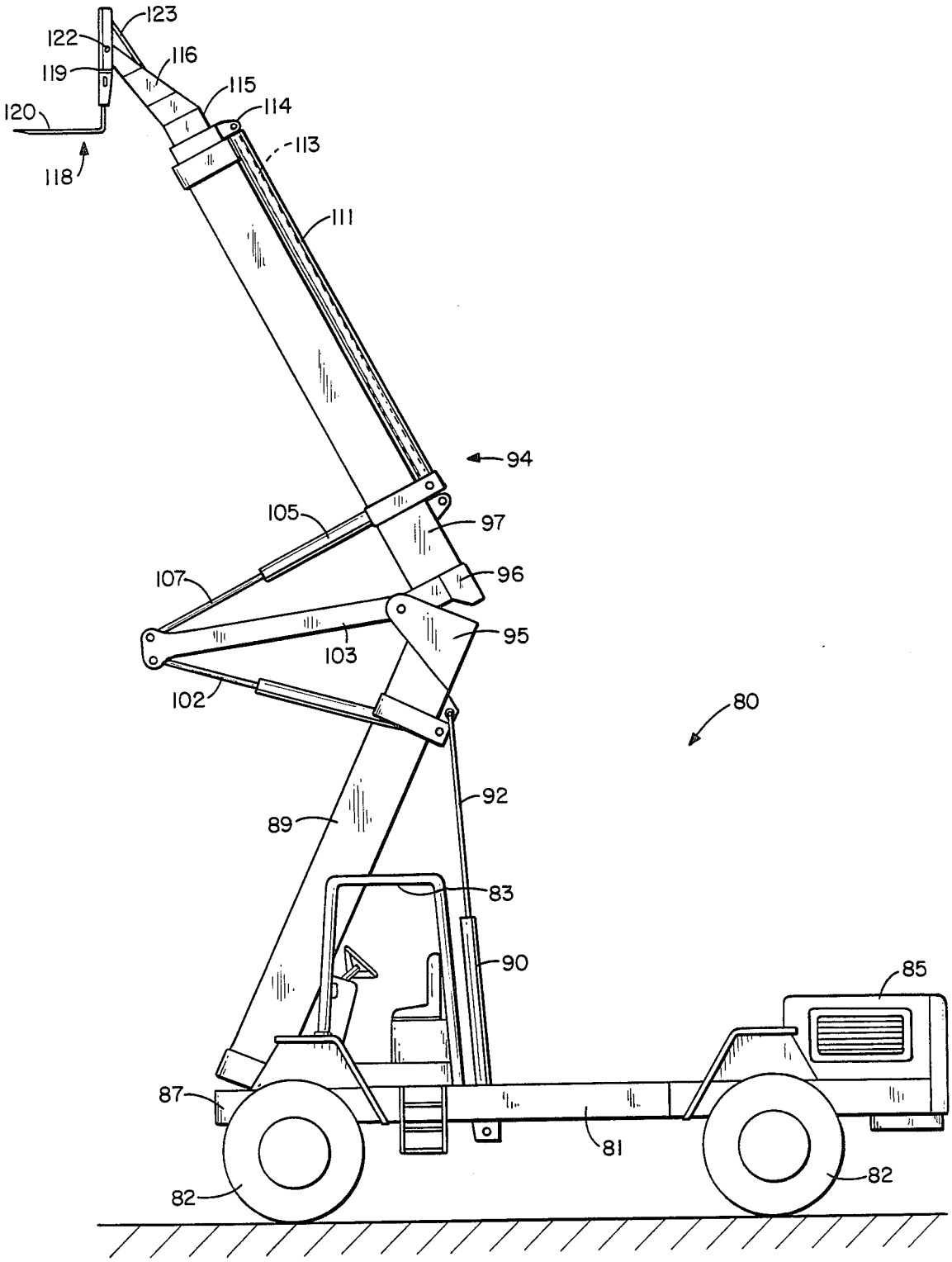
FIG. 10 is a side elevational view of the high-lift loader of FIG. 8 with the boom support frame and boom elevated.

Means for elevating and lowering the boom 94 relative to the movable boom support frame includes first and second pairs of hydraulic power units connected between the boom and the movable frame by a brace structure 103. As shown in FIGS. 7 and 10, a first pair of hydraulic power units includes first and second hydraulic boom lift cylinders 99, 101 with extendible and retractable rods 102. The cylinder end of each unit is connected to the movable frame 89 near the upper end thereof. Outer ends of the rods 102 are connected to the outer ends of a brace 103. Brace 103 is comprised of a pair of parallel elongate members or bars, each connected at a first end to the movahle frame 89 and boom end 96 for rotation coincidental about the second horizontal axis of rotation or the axis of rotation between the boom and the movable frame. The second end of the members comprising brace 103 extend outwardly from the axis of rotation and are connected to the ends of the rods 102.

A second pair of hydraulic power units includes third and fourth boom lift cylinders 105, 106. The cylinder ends of the cylinders 105, 106 are pivotally connected to a portion of the first boom section 97 spaced upwardly a ways from the butt 96. Rods 107 extend and retract from the cylinders 105, 106 and have outer ends which are pivotally connected to the outer ends of the structural members comprising brace 103. The second pair of cylinders 105, 106 and first pair of cylinders 99, 101 are controlled from the cab 83 by the operator as are the movable frame lift cylinders 90, 91. Extension of the rods 102 of the first pair of cylinders 99, 101 lifts the boom along with the brace 103. Extension of the rods 107 of the second pair of cylinders 105, 106 lifts the boom relative to the brace 103.

Boom 94 is comprised of a plurality of boom sections 97, 109, and 110 assembled in telescopic relationship for extension to a full working length, and retraction to a constricted length for over-the-road travel. The second boom section 109 is telescopically engaged in the first boom section 97 for extension and retraction relative thereto. The third boom section 110 is telescopically engaged in the outward end of the second boom section 109 for extension and retraction relative thereto. Extension and retraction of the second boom section 109 with respect to the first boom section 97 is accomplished by a first boom extension hydraulic motor, as shown in FIG. 10, including a cylinder 111 and a rod 113 extendible and retractable with respect to the cylinder 111. The outward end of cylinder 111 is fixed to a collar 114 located on the forward end of the second boom section 109. The rear end of cylinder 111 is fixed to the first boom section 97. Extension of the rod 113 is effected to extend the second boom section 109. The third boom section 110 is extendible and retractable by system of chains and pulleys located interiorly of the boom structure (not shown). The boom is extendible between the full working length, as shown in FIG. 10, with the boom sections extended relative to one another, to be contracted or foreshortened over-the-road travel length of FIG. 8.

Third boom section 110 has a boom tip 115 carrying a load-handling member mounting fixture 116. A forklift assembly 118 is assembled to the fixture 116 and includes a forklift frame 119 carrying a pair of L-shaped forklift members 120. Forklift frame 119 is pivotally connected to the mounting fixture 116 by pivot bar 122 permitting rotation about a horizontal axis. A hydraulic cylinder 123 is connected between the forklift frame 119 and the mounting fixture 116 and is operative to control the angular orientation of the forklift frame 119 and forklift tines 120. If desired, a master-slave cylinder arrangement could be provided as earlier described in order to automatically maintain the forklift tines 120 in a level position.

In use, the loader vehicle 80 is transported over-the-road in the configuration of FIG. 8 with the boom support frame lowered to the chassis 81 of the vehicle on the stationary frame 87. The boom sections 97, 109 and 110 are retracted, and the boom is lowered with respect to the movable boom support frame 89. In such a compact configuration, the loader 80 is easily movable over-the-road. In use as shown in FIG. 9, the hydraulic power unit 90 is operable to lift the movable end of the boom support frame 89 so that the boom tip is orientated downward as shown. In this configuration, the boom can be extended in a downward direction to lower loads to a below-grade location. The forwardly situated operator's cab enables the operator to view the loading and unloading procedure.

In use of the loader as a standard boom reaching upward, from the configuration of FIG. 8, the boom lift cylinders 99, 101 and 105, 106 are operated. Additional vertical lift is achieved by raising the boom support frame 89 using the boom support frame lift unit 90. This configuration is shown in FIGS. 7 and 10. In FIG. 10, the second and third boom sections are retracted, and in FIG. 7, the second and third boom sections are extended. In the configuration of FIG. 7, a load carried on the forklift tines 120 is moved horizontally by simultaneous operation of the boom lift cylinders and the movable support frame lift cylinders. A large measure of added vertical lift is achieved through lifting the movable end of the boom support frame 89 without the sacrifice of having either additional boom sections or longer boom sections which would make over-the-road transport of the unit more cumbersome.

While there have been shown and described certain embodiments of the invention pertaining to a high-lift loader, it is apparent that modifications and deviations can be had from the embodiments shown without departing from the scope and spirit of the invention.

The embodiments of the invention in which an exclusive property or privilege is claimed are defined as follows:

1. A mobile high-lift loader comprising:

a frame assembly including a wheel-mounted main frame and a boom support frame;

said boom support frame having a first end and a second end;

means pivotally connecting the first end of the boom support frame to the main frame for pivotal movement about a first horizontal axis in a first direction to move the second end of the boom support frame from a lowered position adjacent the main frame to an elevated position, and in a second direction opposite to the first direction to move the second end from the elevated position back to a lowered position;

an elongate boom having a butt end and a tip;

means pivotally connecting the butt end of the boom to the second end of the boom support frame for pivotal movement about a second horizontal axis in a first direction to move the boom tip from a lowered position adjacent the boom support frame to an elevated position; and in a second direction opposite the first direction to move the boom tip from the elevated position to the lowered position;

power means for movement of the boom support frame and for movement of the boom;

a load-handling member fixed proximate the boom tip;

a master-slave hydraulic motor assembly to maintain positional relationship of the load-handling member on the boom tip during rotation of the boom support frame and the boom, said assembly including a support frame slave hydraulic motor connected between the support frame and the main frame, a link member having first and second ends pivotally connected at the pivot juncture between the support frame and the boom, a link hydraulic motor connected between the support frame and the first end of the link member, a boom slave hydraulic motor connected between the second end of the link member and the boom, a load-handling member tilt motor connected between the load-handlng member and the boom tip, hydraulic line means interconnecting the hydraulic motors whereby the load-handling member tilt motor acts responsively to movement of the support frame and movement of the boom, said hydraulic motors being constituted as the cylinder-rod type.

2. A load-lifting assembly connectable to vertically stationary structure and having means to maintain positional relationship of a load-handling member, comprising:

a support platform having a first end and a second end;

first pivot means pivotally connecting the first end of the support platform to vertically fixed structure for pivotal movement about a first horizontal axis between a first position with the second end lowered and a second position with the second end elevated;

first power means to move the support platform between its first and second positions;

an elongate boom having a first end and a second end;

second pivot means pivotally connecting the first end of the boom to the second end of the support platform for pivotal movement about a second horizontal axis between a first lower position proximate the support platform and a second elevated position with respect to the support platform;

second power means to move the boom between its first and second positions;

a load-handling member pivotally connected to the econd end of the boom;

a hydraulic motor assembly to maintain positional relationship of the load-handling member during rotation of the support platform and rotation of the boom, including first, second, third and fourth hydraulic motors of the type having a cylinder and a rod extendible and retractable with respect to the cylinder, and a link member pivotally connected between the support platform and the boom at the second pivot means for coaxial rotation therewith and having first and second ends extended opposite directions from the second pivot means;

said first hydraulic motor connected between the vertically fixed structure and the first end of the support platform;

said second hydraulic motor connected between the second end of the support platform and the first end of the link member;

said third hydraulic motor connected between the second end of the link member and the first end of the boom;

said fourth hydraulic motor connected between the second end of the boom and the load-handling member;

hydraulic line means interconnecting the first and second and third and fourth hydraulic motors whereby the fourth hydraulic motor follows movement of the first hydraulic motor responsive to rotation of the support platform, and follows movement of the third hydraulic motor responsive to rotation of the boom.

3. The load-lifting assemhly of claim 2 wherein: said load-handling member is comprised as a forklift assembly.

4. The load-lifting assembly of claim 3 wherein: said first and second power means are comprised as hydraulic power units.

* * * * *